United States Patent [19]

Miura et al.

[11] 4,069,678

[45] Jan. 24, 1978

[54] DEVICE FOR SOLIDIFYING SLUDGY MATERIAL IN A SURFACE LAYER

[75] Inventors: Mitsuo Miura, Tokyo; Yasuo Sugibayashi, Hiroshima; Akio Suzuki, Kashiwa; Yoshinori Kukino, Tokyo; Hayao Aoyagi, Funabashi; Fuminobu Tanifuji, Yachiyo; Jiro Ishii, Tokorozawa, all of Japan

[73] Assignee: Takenaka Komuten Co., Inc., Osaka, Japan

[21] Appl. No.: 727,843

[22] Filed: Sept. 29, 1976

[30] Foreign Application Priority Data

Oct. 16, 1975 Japan ..... 50-125193

[51] Int. Cl.[2] ..... E02D 3/12; E02F 3/00

[52] U.S. Cl. ..... 61/63; 61/36 R; 61/50; 37/77

[58] Field of Search ..... 61/35, 36, 63, 53.52, 61/50; 37/75, 76, 77, 78; 47/1 R

[56] References Cited

U.S. PATENT DOCUMENTS

| | | | |
|---|---|---|---|
| 2,782,605 | 2/1957 | Wertz et al. | 61/36 R |
| 3,964,184 | 6/1976 | Mathieu | 37/78 |

FOREIGN PATENT DOCUMENTS

| | | | |
|---|---|---|---|
| 1,458,165 | 10/1966 | France | 61/35 |

*Primary Examiner*—Jacob Shapiro

[57] ABSTRACT

This invention relates to a device for solidifying sludgy material depositing on the earth surface, the device comprising an agitator having intergrated agitating shafts, each of which is provided with agitating blades. The agitator is attached to a stern of a working barge with a certain angle of inclination and also provided with nozzles for injecting chemical hardener. The device is capable of effectively solidifying the surface sludge over a wide area.

10 Claims, 4 Drawing Figures

DEVICE FOR SOLIDIFYING SLUDGY MATERIAL IN A SURFACE LAYER

BACKGROUND OF THE INVENTION

This invention relates to a device for solidifying sludgy material in a surface layer, and more particularly to a device for setting and reforming the surface layer of accumulated sludge in lakes, sea and other places through natural deposition or artificial dumping of industrial wastes. The device is specifically designed firstly to provide the sludgy surface layer with bearing capacity to allow light equipments or the like to be mounted thereon as a preliminary step when improving the deeper layers, secondly to prevent generation of offensive odor from the sludge pits or swamps, thirdly to prevent outflow of the sludge resulting from inflow of rain water, and finally to effectively utilize land for construction of roads or buildings.

As methods for treatment of the sludgy deposits, A method is generally employed to cover the sludge surface with earth fills to the depth of 2 to 3 meters. This method, however, involves many difficult problems, for instance, inavailability of soil to fill in great quantity in usual case and also environmental pollution such as noise, tremor, dust caused by transportation of earth fills. Furthermore, reformation by earth fills is infeasible for a deep pit or basin, and gathering, transporting and dumping of the earth fills occasionally cost a lot.

Another method is also employed, in some cases, to agitate the sludge by an agitator in place of its deposition while simultaneously injecting chemical hardener into the agitated sludge layer thereby to solidify it.

Among the processors conventionally in the aforementioned methods for treating the surface sludge, a typical one which is well known is that the suspended agitating shafts provided with agitating blades are operatively connected to the driving means. In such processor, the range of agitation by the blades attached in right angle to each agitating shaft is divided along the direction of the vertical section of the processor, so that no sufficient agitation is expected unless being performed by suspending the processor in any given location with moving it up and down. That is, according to the conventional sludge processor, the sludge is agitated and kneaded by moving the agitating blades up and down at a fixed location to treat a unit volume of the sludge, and then the processor is hoisted up, moved horizontally and then again brought down to treat the next batch of the sludge. These operations are repeated until the sludge in a given area is completely worked upon. Such repetition of operations requires much time and labor and results in low working efficiency.

OBJECTS OF THE INVENTION

An object of this invention is to provide a device for agitating and solidifying the surface sludge, which is capable of continuous and efficient solidification of the surface sludge over a wide area.

Another object of this invention is to prevent generation of offensive odor or effluence of pollutants from the industrial waste or sewage treatment plants or other cesspits, thereby to protect the environment against pollution.

Still another object of this invention is to provide useful land for construction of factories or other facilities thereon by proper treatment of cesspools, swamps and such.

A further object of this invention is to provide a method for treatment of surface sludge at low cost by dispensing with expensive enbankment or earth fills.

BRIEF DESCRIPTION OF THE DRAWINGS

The accompanying drawings illustrate an embodiment of this invention.

DESCRIPTION OF PREFERRED EMBODIMENT

Figure 1:
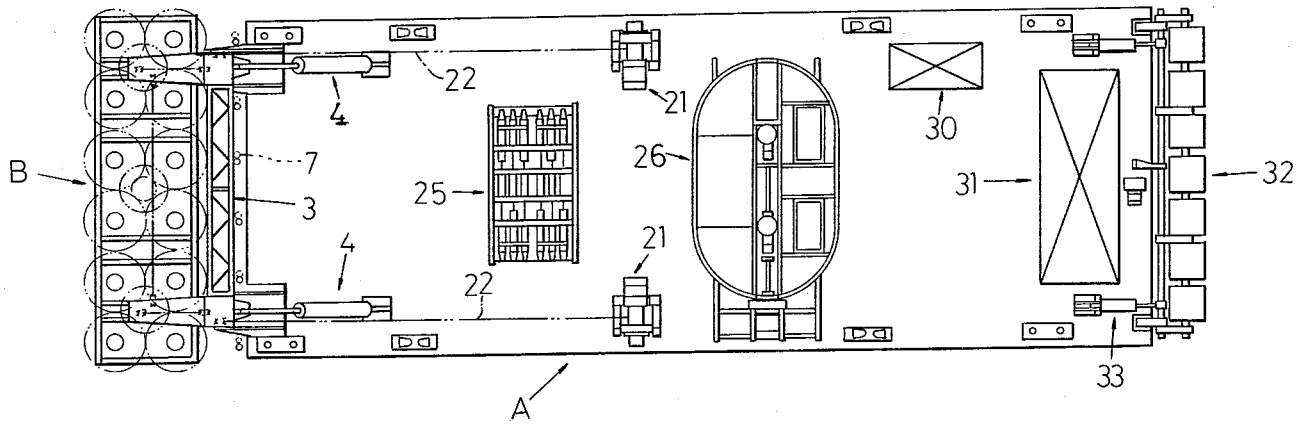
FIG. 1 is a plane view of a processing device according to this invention.

An embodiment of the invention will be described hereafter with reference to FIGS. 1 and 2. A device according to this invention comprises a working barge A and a multi-shaft agitator B mounted at the stern of the barge A. Brackets 1 are projected from the stern of the barge A. A mast 3 is pivotally secured with a pivot 2 in its lower end to the brackets 1, so that the mast 3 may be erected or turned down by means of hydraulic jacks 4 provided between the mast 3 and the barge A. The mast 3 is provided with guide rails 5 and 6 along both sides thereof. A frame 9 for supporting a plurality of injection pipes 7 is slidably fitted on the rails. That is, the frame 9 secures thereto the plurality of pipes 7 for injecting chemical hardener, each of which has at least one injection nozzle 8 at its lower end. A cylinder which accepts therein a hydraulic jack 10 for operating the injection pipes 7 is secured to a side wall of the mast 3. These injection pipes 7 are fixed to the output shaft of said hydraulic jack 10 and supported by the mast 3.

The multi-shaft agitator B comprises a plurality of agitating shafts 12, each of which is provided with agitating blades around its lower end portion. The agitating shafts 12 are pivotally secured to a support frame 17 in mutually parallel and integral arrangement and further in interlocked relation by means of a coupling 16 and a reduction gears shaft of a driving unit 15. The driving unit 15 consists of a motor 13 and the reduction gears 14. Each of agitating shafts is thus formed with an agitating portion *a* at its lower end. The multi-shaft agitator B is also provided with a suspending frame 19 having sheaves 18 pivotally attached thereto, and the frame 19 being secured to the support frame 17 so as to be held in suspension. It will be also seen that the agitating shafts 12 are rotatably supported and suitably spaced apart from each other by steady braces 20 at their lower ends.

The agitator B is slidably mounted on the guide rail 5 by fitting a portion of the support frame 17 thereto. A length of wire rope 22 wound up on a take-up drum of a winch 21 on the barge A is passed round an intermediate sheave 23 pivotally secured to the mast 3 and further round the sheave 18 on the suspending frame 19, whereby the agitator B can be adjustably suspended down from the mast 3 and hoisted up or down through the operation of the winch 21.

The agitating mechanism of this agitator B is so designed as to create a greater width of agitation of the sludge than the lateral one of the barge A. For this purpose, the agitator B may comprises a suitable number of the agitating shafts intergrally assembled and suitably spaced apart from each other, or as shown in drawings, several units of four-shaft agitators may be used in combination in accordance with the agitating condition mentioned above. In the latter case, it is advisable to suspend the wire rope 22 by passing round equalizer sheaves 24 pivotally secured to the mast so that each unit of the four-shaft agitators may be lifted up or down simultaneously in the same way through by the winch operation.

Figure 2:
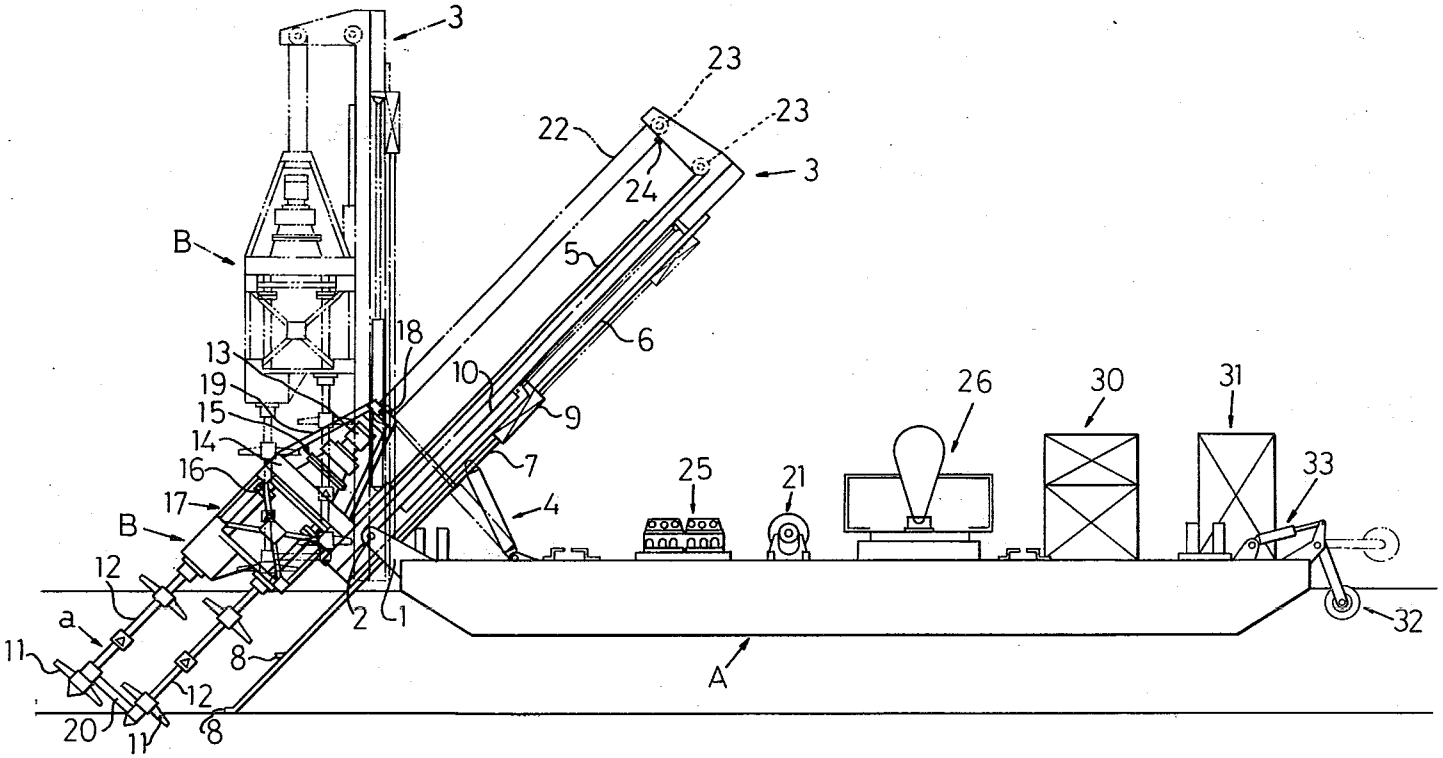
FIG. 2 is a side view thereof.

Each agitating shaft may be provided with one injection pipe 7 having a nozzle in front of the agitating portion of the shaft, that is to say, in the direction of the axial extention of the shaft, or two injection pipes having nozzles at different levels as shown in FIG. 2.

In the agitator B of this invention as described above, the respective agitating shafts 12 are secured to the stern with a certain inclination to the horizontal plane as shown by the solid lines in FIG. 2, and the agitating blades 11 are arranged vertically along each shaft, so that their ranges of agitation overlap each other along the direction of the vertical section. Since the angle of inclination of the agitator B can be arbitrally adjusted by operating the hydraulic jacks 4, the overlapping sectional area of the range of agitators by the respective blades can be suitably determined by adjusting the angle of inclination of the shafts according to the length of the blades 11 and axial intervals therebetween. Such overlapping sectional area is selected to produce the most effective pattern of agitation according to properties of the sludge to be worked upon.

Figure 3:
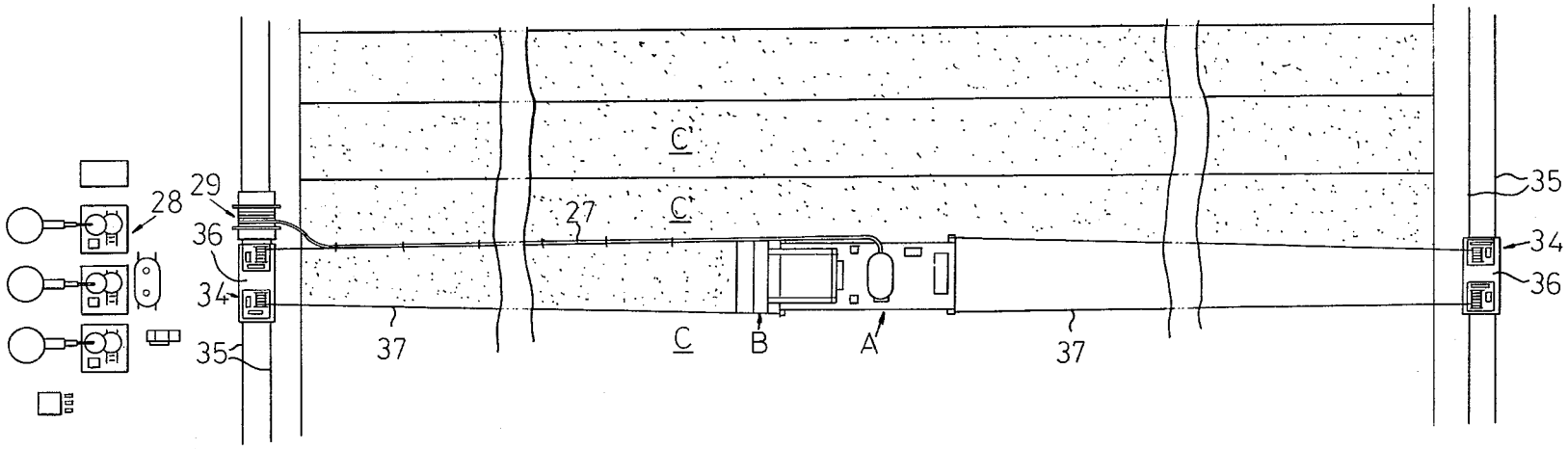
FIGS. 3 and 4 illustrate a mode of sludge treatment by use of the processing device according to this invention, showing a plane view and a side view, respectively.
Figure 4:
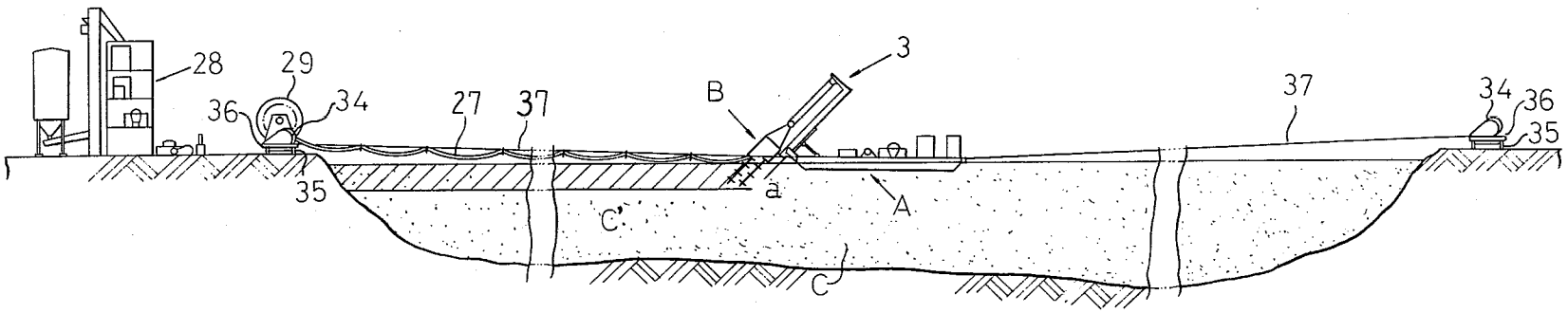

The injection pipes 7 are connected to a pump 25 having distributing valves therein and then to an agitator tank 26, both mounted on the barge A, by way of a pressure-proof feed hose 27, and further connected to a chemical hardener plant 28 installed on the ground via a hose take-up reel 29 being disposed therebetween, as shown in FIGS. 3 and 4. As a result of it, the chemical hardener will be exactly injected from the injection nozzles of the respective injection pipes. A hydraulic unit 30 are also mounted on the barge A drive the hydraulic jacks 4 and 10. And further a generator 31 to feed power to the motor 13 is mounted on the barge A together with the other necessary equipments such as a winch driving motor and so on. If necessary, a cutter assembly 32 rotated with a suitable drive means is disposed at the bow of the barge A, so that such cutter essembly is movable in the vertical direction by hydraulic jacks 33, whereby the surface layer of the sludge is cut and broken to reduce the resistance to barge propulsion.

In operation of the device for treating the surface sludge according to this invention, as shown in FIGS. 3 and 4, the barge A is maintained at a proper position on the sludge deposition C in a cesspool or such by buoyancy, and the agitator B is properly inclined against the horizontal plane. Under this situation, the agitating shafts are rotated and penetrated into the surface layer of the sludge deposition C to agitate the surface sludge, and the chemical agent is simultaneously injected from the injection nozzles of the respective injection pipes 7 into the agitated sludge. Since the injection pipes 7 are urged to make reciprocations by the hydraulic jack 10 while the agitating shafts are rotated, the chemical hardener is injected uniformly and deeply into the agitated portion of the sludge The ranges of rotation or agitation of the respective agitating blades provided to the respective agitating shafts overlap each other along the direction of vertical section, because the agitating shafts 12 are disposed with an inclination to the horizontal plane. As a result, uniform agitation of the surface layer of the sludge can be accomplished without moving the agitator up and down, but with merely keeping it at a fixed position.

In a preferred mode of operation of the present processing device, such as shown in FIGS. 3 and 4, winches 34 are mounted on the respective trucks 36 movably supported on the rails 35 laid along both sides of a cesspool or such, and wire ropes 37 wound up on the respective winches are connected to the barge A to tow it through operating the winches so as to treat the surface layer of the sludge stripwise and continuously. After completion of treatment along one strip, winches 34 are moved transversely along the rails 35 to carry the device toward the non-treated area and then back to the starting point. Thereafter, the processing device is now advanced along the edge of the already treated area C' to repeat the same operation as described above to process the sludge. The similar operations are carried out repeatedly until the desired area of the sludge deposition is entirely processed.

The mast 3 can be raised up to the erect position by operating the hydraulic jacks 4 to maintain the agitator B in an upright position as shown with dotted lines in FIG. 2. This position is convenient for mounting and demounting of the agitator. It is also possible to drive the winches 21 while maintaining the agitator in this upright position in order to perform solidification of the deep layer of the sludge by moving it up and down.

Thus, according to the processing device of this invention, the area of agitation covered by each agitating blade along the direction of vertical section is increased. Since the ranges of agitation by the respective blades overlap each other in both vertical and horizontal directions, continuous and efficient solidification of the surface sludge deposition can be accomplished easily without moving the agitator up and down, but merely moving it laterally along the surface sludge layer. Also, since the injection pipes disposed in front of the agitating shafts are arranged to be reciprocally movable in the vertical direction and then capable of injecting the chemical hardener uniformly into the surface sludge, mixing and agitating the surface sludge with the chemical hardener can be accomplished to obtain the solidified sludge layer with uniform sectional strength. It is thus possible by use of the processing device according to this invention to accomplish solidification treatment of the surface sludge over a wide span of sludge deposition with high efficiency, a short period of work and highly economical effects.

What we claim is:

1. A device for solidifying sludgy material in a surface layer comprising:

a working barge;

an agitator assembly mounted on said working barge at its stern, said assembly including a plurality of agitating shaft means having agitating blades at the lower portion of each of said shafts, means for driving the agitating shaft means including a motor and reduction gears, and a support frame for joining and supporting said agitating shaft means and said means for driving the agitating shaft means;

a mast hingedly mounted on said barge slidably suspending said support frame;

hydraulic jack means for controlling the inclination of said mast;

guide rails along both sides of and parallel to said mast for slidably guiding said support frame;

winch means mounted on said barge for winding and unwinding wire rope to lift and lower said support frame on said mast;

means for distributing a chemical hardener, including injection pipes for carrying the chemical hardener into the sludge layer adjacent said blades, said pipes being slidably mounted on said mast; and means for sliding said pipes along said mast;

wherein said agitating blades are arranged such that the range of agitation formed by each blade extends in both the vertical and horizontal directions.

2. The device claimed in claim 1, wherein said agitating shafts include at least one set of four agitating shafts sychronously rotated by said motor and reduction gears.

3. The device claimed in claim 1, wherein the blades of said agitating shafts overlap the blades of adjacent shafts in the vertical direction.

4. The device claimed in claim 1, further comprising a plurality of sheaves on said mast for guiding said wire rope from said winch.

5. The device claimed in claim 1, further comprising:

means for producing chemical hardener located adjacent the sludgy material;

a hose extending between said means for producing and said injection pipes; and a hose reel for holding said hose.

6. The device claimed in claim 1, further comprising:

a cutter assembly mounted on the bow of said barge;

drive means for turning said cutter assembly; and jack means for vertically moving said cutter means.

7. The device claimed in claim 1, further comprising means for moving said barge over the sludgy material, including:

rails extending along two opposite sides of the sludgy material;

trucks movable along said rails;

winches mounted on said trucks; and wire cable attached to said winches and said barge.

8. The device claimed in claim 1, wherein said means for distributing the chemical hardener includes means for pumping and valves to feed the chemical hardener separately into said injection pipes.

9. The device claimed in claim 8, wherein said means for pumping includes a plurality of reciprocating pumps connected in parallel.

10. The device claimed in claim 1, wherein said injection pipes are moved up and down at a fixed cycling period independent of the motion of said agitating shaft means.

* * * * *